US005118127A

United States Patent [19]

Partington

[11] Patent Number: 5,118,127

[45] Date of Patent: Jun. 2, 1992

[54] HITCH DEVICE FOR INTERCONNECTING MOBILE APPARATUS IN TANDEM

[76] Inventor: Michael J. Partington, 301 Kessler Blvd., West Drive, Indianapolis, Ind. 46208

[21] Appl. No.: 444,019

[22] Filed: Nov. 30, 1989

[51] Int. Cl.[5] ..... A61G 1/04; B60D 1/52

[52] U.S. Cl. ..... 280/488; 280/304.1; 280/480; 280/483; 267/72; 267/291; 403/100; 403/286

[58] Field of Search ..... 280/483, 488, 484, 493, 280/494, 486, 480, 474, 304.1, 292, 288.4; 403/100, 102, 229, 286, 54; 267/169, 291, 72, 150; 213/66, 68, 178

[56] References Cited

U.S. PATENT DOCUMENTS

| | | | |
|---|---|---|---|
| 1,507,177 | 9/1924 | Henrikson | 213/178 |
| 2,474,690 | 6/1949 | Robinson et al. | 403/286 |
| 2,723,134 | 11/1955 | Antes | 280/488 |
| 3,224,224 | 12/1965 | Kudriavetz | 64/11 |
| 3,789,464 | 2/1974 | Collanus | 280/480 |
| 4,444,409 | 4/1984 | Garrison | 280/492 |
| 4,511,158 | 4/1985 | Varga et al. | 280/292 |
| 4,529,937 | 7/1985 | Cornelius | 403/100 |
| 4,572,536 | 2/1986 | Doughty | 280/289 |
| 4,588,199 | 5/1986 | Fisher | 280/204 |
| 4,596,399 | 6/1986 | Clark | 280/492 |
| 4,711,461 | 12/1987 | Fromberg | 280/494 |
| 4,768,803 | 9/1988 | Hewitt | 280/478.1 |

FOREIGN PATENT DOCUMENTS

| | | | |
|---|---|---|---|
| 235201 | 12/1909 | Fed. Rep. of Germany . | |
| 2451510 | 11/1980 | France | 280/480 |
| 0009930 | 2/1915 | United Kingdom | 280/488 |
| 8902235 | 3/1989 | World Int. Prop. O. | 280/494 |

*Primary Examiner*—Charles A. Marmor
*Assistant Examiner*—Anne Marie Boehler
*Attorney, Agent, or Firm*—Baker & Daniels

[57] ABSTRACT

The invention is a hitch device for interconnecting two mobile apparatus, such as a hospital gurney and an IV stand. The hitch device comprises a body having first and second ends, each end having a coupling for attachment to a mobile apparatus, and a monoplanarly flexible intermediate portion disposed between the first and second ends. The intermediate portion includes a chain, which is oriented so that only lateral flexing is permitted when the device is in use. The intermediate portion also includes a resilient tube or spring for biasing the intermediate portion to an axial position. A stop located on the first end prevents upward rotation of the intermediate portion beyond a horizontal position when the device is in use.

12 Claims, 4 Drawing Sheets

HITCH DEVICE FOR INTERCONNECTING MOBILE APPARATUS IN TANDEM

FIELD OF INVENTION

The invention relates to hitch devices for interconnecting two mobile apparatus, such as a hospital gurney and a mobile intravenous (IV) infusion stand.

BACKGROUND OF INVENTION

Mobile apparatus, such as a hospital gurney and a mobile intravenous (IV) infusion stand, must sometimes be moved in tandem. Such a situation occurs when a patient who is connected to an IV apparatus must be transported by a gurney or wheelchair. It is extremely awkward for one person to simultaneously move both mobile apparatus.

Such mobile apparatus may be simultaneously moved more easily if interconnected by a hitch device. However, the hitch device must impart stability to the interconnected apparatus upon movement. For example, the hitch device must prevent a tall, sometimes top-heavy apparatus, such as a mobile IV stand, from bouncing and tipping over during transport, particularly when bumps in a floor are encountered.

Prior hitch devices do not permit a pulled apparatus to closely track the path of the pulling apparatus. This lack of tracking requires a larger space to traverse corners and makes it more difficult to control the movement of both apparatus. Although this problem may be partially solved by providing a hitch which maintains the pulled apparatus to one side of the pulling device, such an arrangement only makes it easier to traverse corners in one direction (opposite the side of the pulled apparatus). Moreover, these devices create an additional problem, namely, the pulling and pulled apparatus require a wider path. This is particularly disadvantageous in crowded areas such as hospital corridors. Further, when traversing a corner, the pulled apparatus will not ride smoothly and may even tip over (especially if the pulled apparatus is a top-heavy object like a mobile IV infusion stand) in response to the abrupt change in direction. However, the change in direction will not be so abrupt and the pulled apparatus will ride more smoothly if the hitch device connecting the pulling and pulled apparatus will flex laterally. It would also be advantageous for the hitch device to automatically realign the pulled and pulling apparatus to an axial position after traversing a corner to provide a minimum path width for the tandem apparatus.

The following patents disclose hitch devices that permit lateral movement of one of the interconnected mobile apparatus: Garrison, U.S. Pat. No. 4,444,409 (issued Apr. 24, 1984) (FIGS. 2 and 3); Fisher. U.S. Pat. No. 4,588,199 (issued May 13, 1986) (FIG. 1, lateral movement possible around ball element 12); Clark, U.S. Pat. No. 4,596,399 (issued Jun. 24, 1986) (lateral movement possible by pivoting around kingpins 33, column 4, lines 17–22 and FIGS. 5–7); Fromberg, U.S. Pat. No. 4,711,461 (issued Dec. 8, 1987) (lateral movement possible by rotation around axis b, FIG. 2). However, none of these devices has resilient means for restoring the hitch device to its original configuration after traversing a corner. Further, none of these hitch devices importantly restrict vertical movement (bouncing) of a lightweight interconnected apparatus.

Kudriavetz, U.S. Pat. No. 3,224,224 (issued Jun. 7, 1963), discloses a flexible coupling that has torsional resilience (FIG. 2 and col. 1, lines 37–42). Although it is known to use the device disclosed in Kudriavetz to interconnect two mobile apparatus, the device disclosed in Kudriavetz does not restrict vertical movement (bouncing) of a lightweight interconnected apparatus.

Kahlert, German Patent No. 235,201, discloses a coupling device which includes a spring. IV pole coupling devices that somewhat restrict vertical movement of an IV pole are disclosed in representative U.S. Pat. Nos. 4,511,158 and 4,572,536.

OBJECTS OF THE INVENTION

It is an object of the invention to provide a hitch device for interconnecting mobile apparatus in tandem.

It is a further object of the invention to provide a hitch device that will prevent vertical movement, tipping and bouncing of an interconnected apparatus.

It is another object of the invention to provide a hitch device with resilient means for biasing a pulled apparatus toward straight alignment with the pulling apparatus.

Another object of the invention is to provide a hitch device that is movable to an unused position in which it does not outwardly project from the vehicle to which it is connected.

Still other objects and advantages of the invention will become apparent to those of skill in the art after reading the following detailed description of the invention.

SUMMARY OF THE INVENTION

The invention is a hitch device for interconnecting two mobile apparatus, such as a hospital gurney and an IV stand. The hitch device comprises a body having first and second ends, each end having means for attachment to a mobile apparatus, and a monoplanarly flexible intermediate portion, disposed between the first and second ends. The intermediate portion includes a chain, which is oriented so that only lateral flexing is permitted when the device is in use. The intermediate portion also includes means for biasing the intermediate portion to an axial position. Stop means located on the first end prevents upward rotation of the intermediate portion beyond a horizontal position when the device is in use.

DETAILED DESCRIPTION OF THE INVENTION

Figure 1:
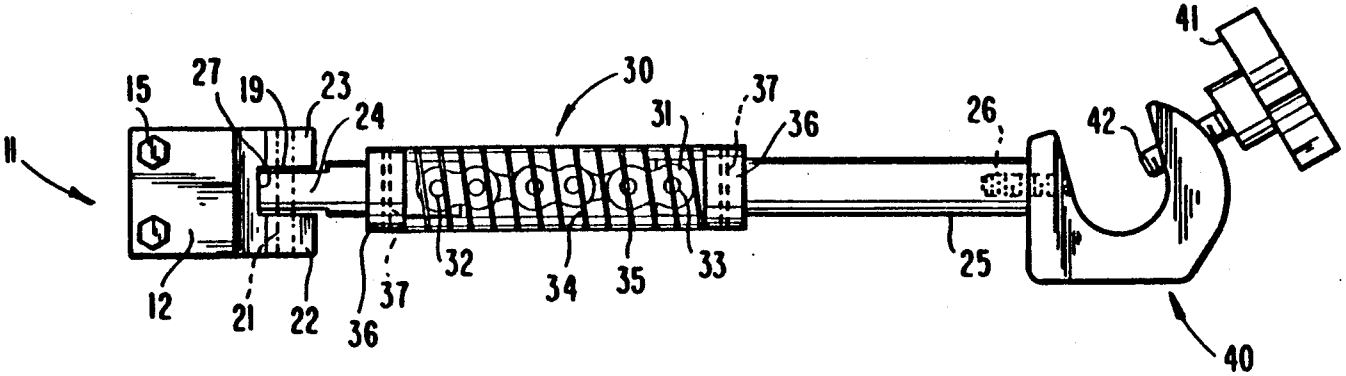
FIG. 1 is a top view of a first embodiment of the hitch device.
Figure 2:
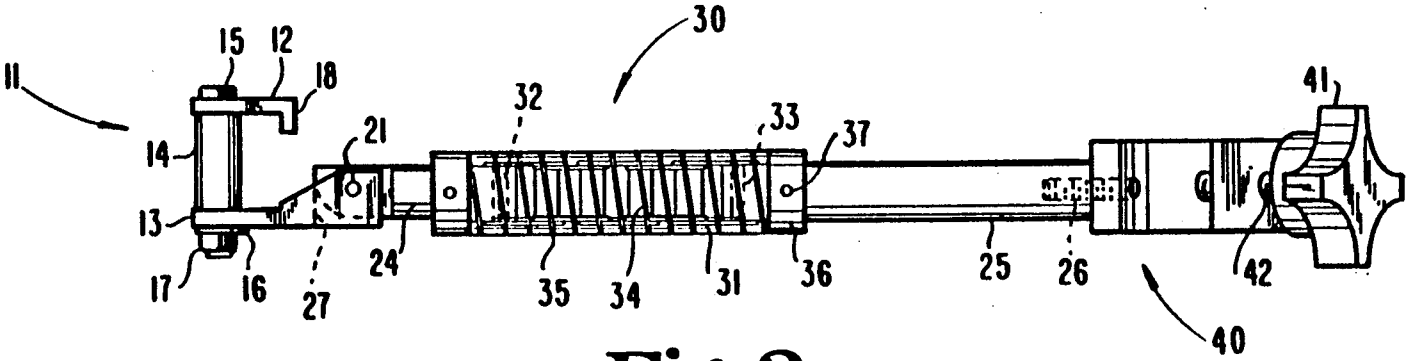
FIG. 2 is a lateral view of the first embodiment of the hitch device.

The hitch device comprises a body having first end 11, attachable to a first mobile apparatus, second end 40, attachable to a second mobile apparatus, and an intermediate portion, which is monoplanarly flexible (flexible only in one plane) and is disposed between the first and second ends (FIGS. 1 and 2).

First end 11 may be constructed of opposing first and second horizontal plates, 12 and 13, respectively, which are vertically spaced by hollow, cylindrical sleeves 14 (FIG. 2). The plates are secured by opposing threaded bolts 15, which are passed through opposing holes in the first ends of plates 12 and 13 (FIG. 2). As shown in FIG. 2, the headed end of bolt 15 abuts a surface of plate 12 and the threaded end of bolt 15 protrudes from the surface of plate 13. A washer 16 is passed over the threaded end of bolt 15 and is secured to a surface of plate 13 by screwing threaded nut 17 onto the threaded end of bolt 15 until washer 16 is firmly secured to the surface of plate 13 as shown in FIG. 2.

At the second end of first plate 12 is a lip 18, which grips the first mobile apparatus and aids in securing the first end 11 to the first mobile apparatus (FIG. 2).

Intermediate portion 30 is pivotally mounted on first end 11 by means of pivot pin 21, which extends transversely through projections 22 and 23 and end 24 of intermediate portion 30 (FIGS. 1 and 2). Pin 21 is secured to projections 22 and 23 by gluing or welding.

At the second end of the second coupling plate 13 is a notch 19 (FIG. 1), which forms a stop 27, preventing intermediate portion 30, which during use is only laterally flexible, from rotating above a horizontal position (FIG. 2). As FIG. 2 reveals, end 24 of intermediate portion 30 is curved so that it is shorter on one side of pivot pin 21 than on the opposite side of pin 21. When intermediate portion 30 is rotated upwardly about pin 21 from a downwardly vertical position (the stored position) (FIG. 6), the longer side of end 24 engages the surface of stop 27 when intermediate portion 30 reaches a horizontal position, thus preventing upward rotation of portion 30 beyond a horizontal position.

In the preferred embodiment of intermediate portion 30, link chain 31 is connected to end 24 by link pin 32 (FIG. 1). Link pin 32 extends through a hole in end 24 as depicted in FIGS. 1 and 2, thus securing chain 31 to end 24. Likewise, link pin 33 is secured to end 25.

Figure 6:
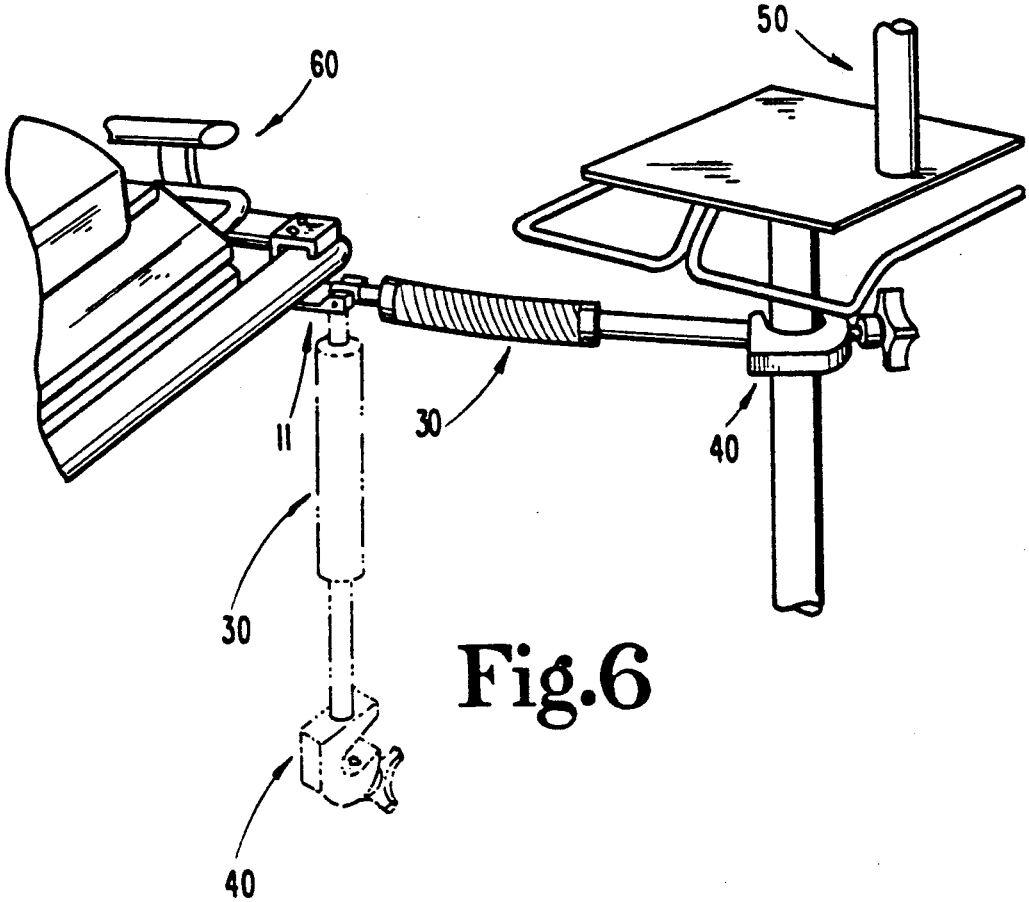
FIG. 6 shows the first embodiment of the hitch device interconnecting a hospital gurney and an IV stand.
Figure 7:
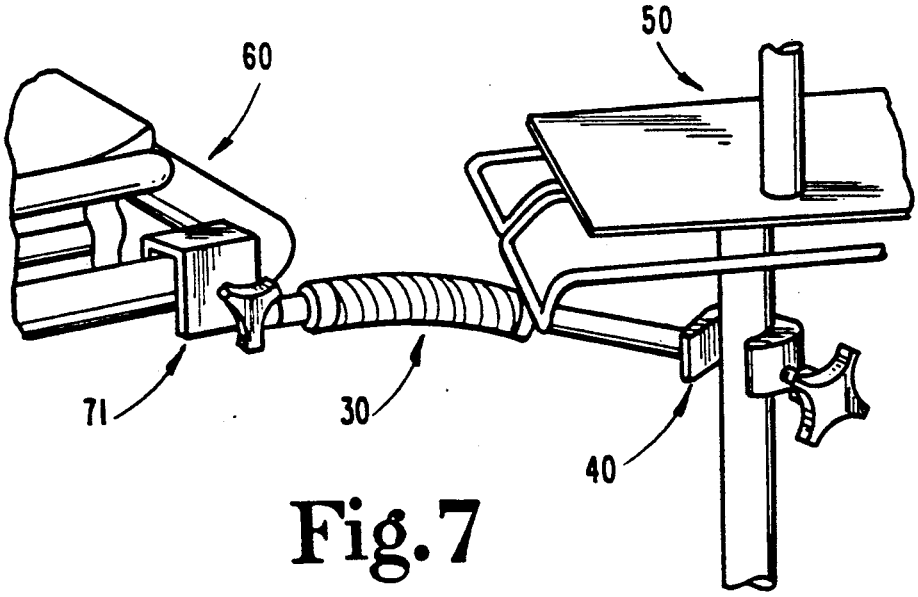
FIG. 7 shows the second embodiment of the hitch device interconnecting a hospital gurney and an IV stand.

Chain 31 imparts monoplanar flexibility to intermediate portion 30 and is oriented as shown in FIG. 1 so that intermediate portion 30 may only bend laterally when the hitch device is in use (FIGS. 6 and 7). Chain 31, which is disposed within the central cavity of coil spring 34, permits intermediate portion 30 to bend laterally in response to lateral forces exerted upon it, such as those forces incurred when travelling around corners with two apparatus connected by the hitch. After the corner is traversed, lateral forces cease and intermediate portion 30 is restored to an axial (or straight) alignment position by coil spring 34, which biases intermediate portion 30 to a straight alignment position.

Surrounding chain 31 and spring 34 is a flexible, clear plastic sheath 35, such as TYGON tubing. Flexible plastic sheath 35 is held in place by opposing collars 36 at opposing ends of 35. Opposing collars 36 are held in place by pins 37, which are pressed into the collars (FIGS. 1 and 2).

To provide the tightest fit between the collars for sheath 35, the sheath should be heated in boiling water (to temporarily increase its flexibility), inserted over chain 31 and snugly fitted against opposing collars 36.

Alternatively, spring 34 and sheath 35 may be replaced by resilient rubber or resilient plastic tubular materials that are biased toward axial (or straight) alignment.

As shown in FIGS. 1 and 2, end 25 of intermediate portion 30 is secured to second end 40, which is used to connect a second mobile apparatus, such as IV stand 50 (FIGS. 6 and 7). Second end 40 may be secured to end 25 by means of threaded stud 26, which may be glued or welded into a threaded opening in second end 40 and end 25 (FIG. 1).

Second end 40 is a C channel which includes a knob 41 that has a threaded projection 42, preferably made of brass. Threaded projection 42 is screwed through a threaded hole in second end 40 as shown in FIG. 1, thus enabling second end 40 to be detachably secured to a second mobile apparatus.

Figure 4:
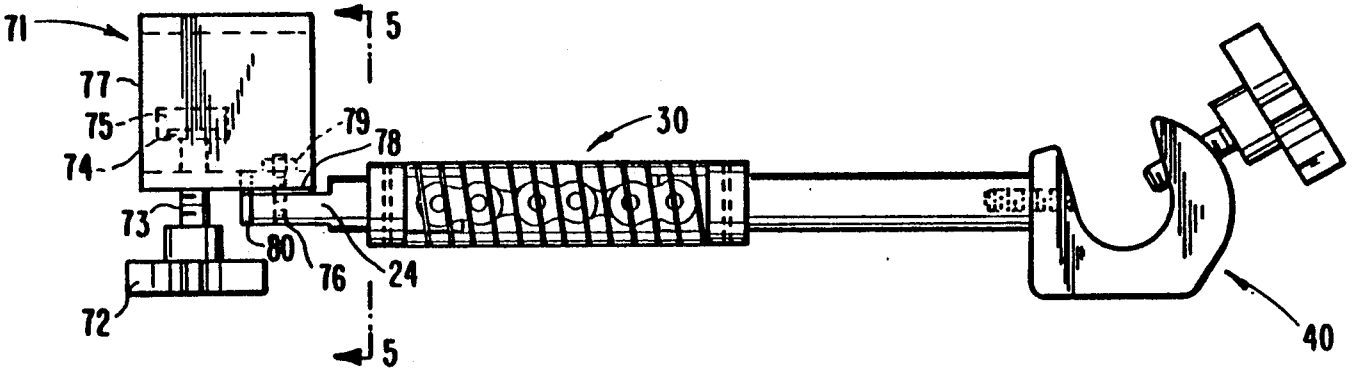
FIG. 4 is a top view of the second embodiment of the hitch device.
Figure 3:
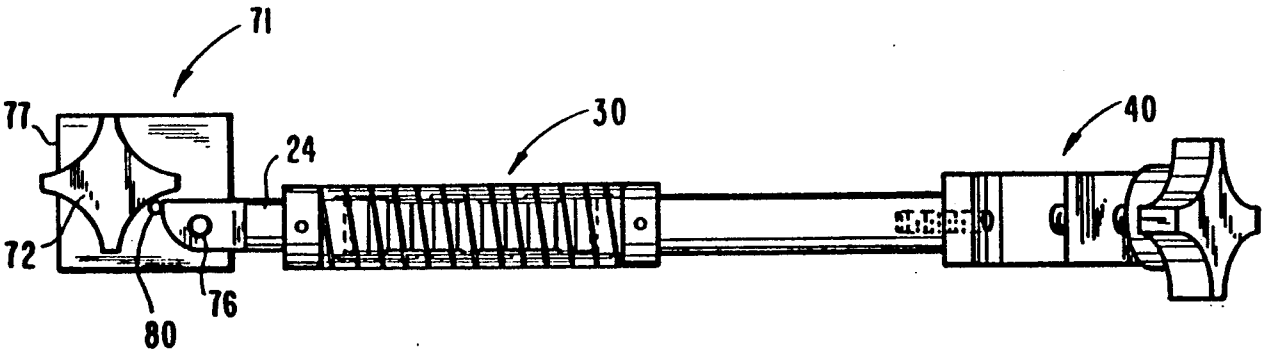
FIG. 3 is a lateral view of a second embodiment of the hitch device.
Figure 5:
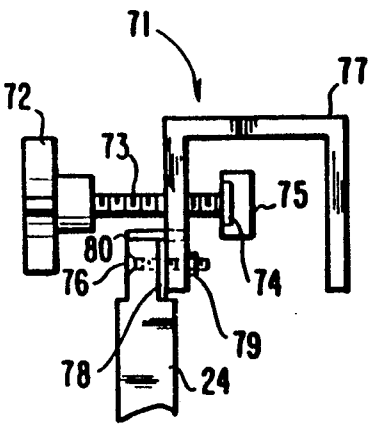
FIG. 5 is an end view taken on line 5—5 of FIG. 4.

An alternative design for first end 11 is shown as 71 in FIGS. 3, 4 and 5. First end 71 is an integrally formed C channel 77 that is detachably mountable to a first mobile apparatus by means of knob 72, which has a threaded projection 73. Threaded projection 73 is threaded through a threaded opening in 71 as shown in FIGS. 4 and 5. The end of projection 73 opposite knob 72 is provided with a flattened end 74. A polyvinyl chloride plastic cap 75 is then glued (solvent welded) over end 74 to provide a nonscratch contact surface for securement of 71 to the first mobile apparatus.

In this second embodiment of the hitch device, intermediate portion 30 is pivotally mounted on threaded screw 76 as shown in FIGS. 3, 4 and 5. Threaded screw 76 is inserted through a hole in end 24 of intermediate portion 30 and washer 78. Threaded screw 76 is then screwed through a threaded hole in 77 and through nut 79. Nut 79 is secured to screw 76 (for example, by welding) to prevent nut 79 from coming off of screw 76 (see FIGS. 4 and 5). Intermediate portion 30 is prevented from upward vertical rotation above a horizontal position by stop 80 (see FIG. 3), which is a pin that has a threaded end and a smooth end, the threaded end being screwed into a threaded opening in 77, as shown in FIGS. 4 and 5.

As FIG. 3 reveals, end 24 is curved so that it is shorter on one side of screw 76 than on the opposite side of screw 76. When intermediate portion 30 is rotated upwardly about screw 76 from a downwardly vertical position, the longer side of end 24 engages stop 80 when intermediate portion 30 reaches a horizontal position, thus preventing upward rotation of 30 beyond a horizontal position.

Figure 9:
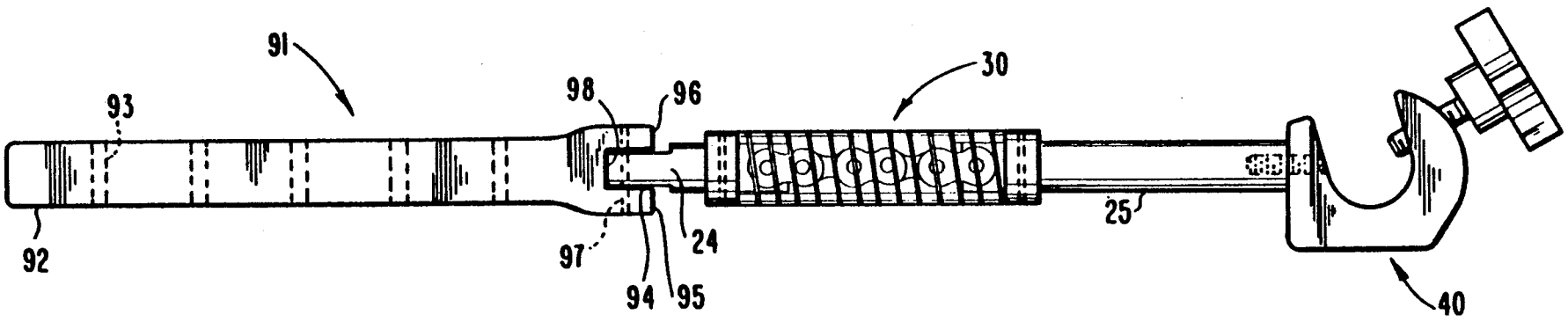
FIG. 9 is a top view of the third embodiment (preferred embodiment) of the hitch device.
Figure 8:
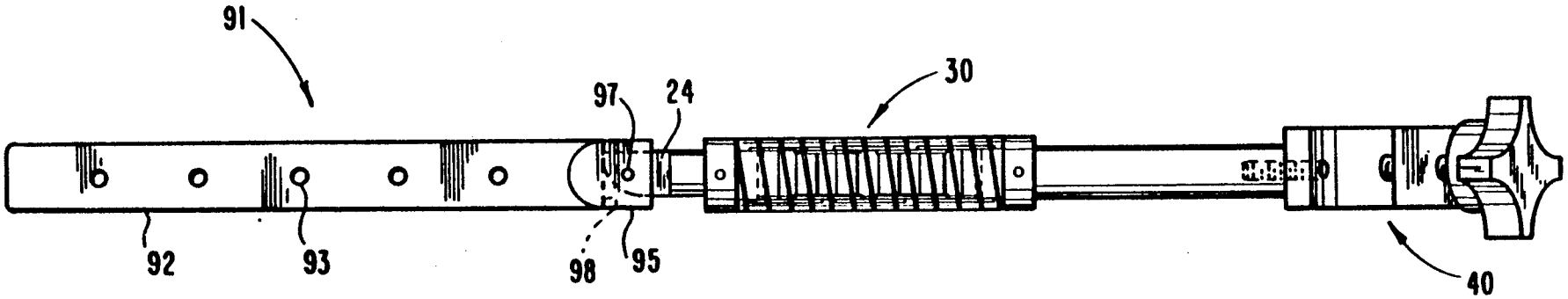
FIG. 8 is a lateral view of the third embodiment (preferred embodiment) of the hitch device.

A third alternative design for the first end is shown as 91 in FIGS. 8 and 9. FIGS. 8 and 9 represent the preferred embodiment of the hitch device.

First end 91 is a rod 92 having bolt holes 93 that extend transversely through rod 92 (FIG. 9). At one end of 92 is notch 94, which forms stop 98 (FIGS. 8 and 9). As shown in FIG. 8, intermediate portion 30 is prevented from upward rotation beyond a horizontal position in the same way as the embodiment shown in FIG. 2.

Intermediate portion 30 is pivotally mounted on first end 91 by means of pivot pin 97, which extends transversely through projections 95 and 96 and 24 of intermediate portion 30 (FIGS. 8 and 9). Pin 97 is secured to projections 95 and 96 by gluing or welding.

First end 91 is secured to the first mobile apparatus by drilling holes in the first mobile apparatus (for example, in a rail) that align with holes 93. Bolts having a threaded end and a headed end may then be inserted through holes 93 and the corresponding holes in the first mobile apparatus. A washer may then be inserted over the threaded end of each bolt, followed by insertion of a nut, which is screwed onto the threaded end of the bolt until first end 91 is secured to the first mobile apparatus.

Alternatively, first end 91 may have transverse circular grooves instead of bolt holes 93. First end 91 would then be secured to the first mobile apparatus by hose clamps, which would be wrapped around the transverse circular grooves and a portion of the first mobile apparatus (for example, a rail). To protect against sharp surfaces of the hose clamp, rubber tubing may be used to enclose the hose clamp, which is often made of metal.

The rigid materials of the hitch device, such as ends 24 and 25 of intermediate portion 30 and the first and second ends 91 (or 11 or 71) and 40, may be made of metal, hard plastic, hard rubber, or any other rigid material.

FIGS. 6 and 7 show the hitch device interconnecting a hospital gurney 60 and an IV stand 50. FIG. 6 shows the hitch device with the first embodiment 11 of the first end. FIG. 7 shows the hitch device with the second embodiment 71 of the first end.

Further, FIG. 6 reveals the hitch device in a first horizontal outwardly projecting position (use position) connected to IV stand 50, and a second vertically hanging storage position.

In operation, the hitch device interconnects a mobile pulling apparatus, such as gurney 60, and a mobile pulled apparatus, such as IV stand 50, in axial alignment (FIG. 6). Axial alignment provides a minimum width when both apparatus are moved in tandem. When both apparatus are moved in tandem, the stop means located on the first end of the hitch device and the orientation of chain 31 prohibit rotation of intermediate portion 30 above a horizontal position, thus preventing bouncing of the pulled apparatus that often causes the pulled apparatus to tip over.

While traversing a corner, chain 31 permits lateral movement of the pulled apparatus to a non-axial alignment with the pulling apparatus. Therefore, the pulled apparatus does not change direction so abruptly and as a result travels more smoothly around the corner.

After traversing a corner, coil spring 34 returns the pulled apparatus to axial alignment, thus providing a minimum width for the tandem apparatus, which is important in tight places, such as a crowded hospital hallway.

When the device is not being used, intermediate portion 30 rotates downwardly about pivot 21, 76, or 97 and conveniently hangs out of the way of objects that could bump into it if it were projecting outwardly (the storage position, FIG. 6).

Many changes could be made in the above procedures and many apparently widely different embodiments of this invention could be made without departing from the scope thereof, and it is intended that all matter contained in the above description or shown in the accompanying drawings shall be interpreted as illustrative and not in a limiting sense.

I claim:

1. A device for connecting wheeled apparatus, comprising:

a body having first and second ends, the first end having means for attachment to a pulling mobile apparatus and the second end having means for attachment to a pulled ground-engaging mobile apparatus, the pulled apparatus being movable in a laterally arcuate direction with respect to the pulling apparatus, and a monoplanarly flexible intermediate portion of the body, disposed between the first and second ends, the intermediate portion having means for biasing the intermediate portion toward axial alignment and an axially nonextendable monoplanarly flexible chain, oriented for flexure in a horizontal plane.

2. The device of claim 1 wherein the means for biasing the intermediate portion of the body comprises: a resilient tubular material having a central cavity, the monoplanarly flexible chain being disposed within the cavity.

3. The device of claim 1 wherein the means for biasing the intermediate portion of the body comprises:

a coil spring having a central cavity, wherein the monoplanarly flexible chain is disposed within the cavity.

4. The device of claim 3, further comprising a flexible plastic sheath surrounding the coil spring.

5. The device of claim 1, further comprising pivot means between the first end and the intermediate portion of the body.

6. The device of claim 5 further comprising stop means to limit the extent of pivot between the first end and the intermediate portion of the body.

7. The device of claim 6 wherein the stop means comprises:

an end of the intermediate portion of the body which is shorter on one side of the pivot point than on the opposite side of the pivot point, a surface on the first end, pivotally engagable with the longer end portion of the end of the intermediate portion of the body.

8. A device for connecting wheeled apparatus, comprising:

a body having first and second ends, each end having means for attachment to a mobile apparatus, an intermediate portion of the body disposed between the first and second ends, the intermediate portion comprising a monoplanarly flexible chain disposed such that the intermediate portion is flexible only in a horizontal plane when the first and second ends are each attached to a mobile apparatus, pivot means between the first end and the intermediate portion of the body such that the device is pivotable between a first horizontal outwardly projecting position in which the second end is attachable to a mobile apparatus, and a second storage position in which the intermediate portion of the body vertically hangs from the first end, and stop means to limit the extent of pivot between the first end and the intermediate portion of the body so that the intermediate portion of the body may not be pivoted beyond a horizontal position.

9. The device of claim 8, wherein the intermediate portion has means for biasing the intermediate portion toward axial alignment.

10. The device of claim 9, wherein the means for biasing the intermediate portion of the body comprises:

a resilient tubular material having a central cavity.

11. The device of claim 9 wherein the means for biasing the intermediate portion of the body comprises:

a coil spring having a central cavity.

12. The device of claim 11, further comprising a flexible plastic sheath surrounding the coil spring.

* * * * *